US010290415B2

(12) United States Patent
Koizumi

(10) Patent No.: US 10,290,415 B2
(45) Date of Patent: May 14, 2019

(54) ELECTRONIC COMPONENT AND MANUFACTURING METHOD THEREFOR

(71) Applicant: Murata Manufacturing Co., Ltd., Kyoto (JP)

(72) Inventor: Kazuya Koizumi, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/056,696

(22) Filed: Feb. 29, 2016

(65) Prior Publication Data

US 2016/0260539 A1 Sep. 8, 2016

(30) Foreign Application Priority Data

Mar. 2, 2015 (JP) ..... 2015-040497

(51) Int. Cl.

| | |
|---|---|
| ***H01F 17/00*** | (2006.01) |
| ***H01F 27/29*** | (2006.01) |
| ***H01F 27/245*** | (2006.01) |
| ***H01F 41/02*** | (2006.01) |
| ***H01F 17/04*** | (2006.01) |
| ***H01F 41/10*** | (2006.01) |

(52) U.S. Cl.

CPC ..... *H01F 27/29* (2013.01); *H01F 17/0013* (2013.01); *H01F 17/045* (2013.01); *H01F 27/245* (2013.01); *H01F 27/292* (2013.01); *H01F 41/02* (2013.01); *H01F 41/10* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 4,543,553 | A * | 9/1985 | Mandai | H01F 41/046 336/200 |
| 6,169,470 | B1 * | 1/2001 | Ibata | H01F 17/0006 336/200 |
| 6,210,596 | B1 | 4/2001 | Takenaka et al. | |
| 6,304,164 | B1 * | 10/2001 | Ohno | H01F 17/0006 29/602.1 |
| 2005/0018382 | A1 | 1/2005 | Takazawa | |

(Continued)

FOREIGN PATENT DOCUMENTS

| | | | |
|---|---|---|---|
| CN | 1130735 | C | 12/2003 |
| CN | 103764592 | A | 4/2014 |

(Continued)

OTHER PUBLICATIONS

An Office Action; "Notification of Preliminary Rejection," issued by the Korean Patent Office dated Jun. 21, 2017, which corresponds to Korean Patent Application No. 10-2016-0024307 and is related to U.S. Appl. No. 15/056,696; with English language translation.

(Continued)

*Primary Examiner* — Tszfung J Chan
(74) *Attorney, Agent, or Firm* — Studebaker & Brackett PC

(57) ABSTRACT

An electronic component which can achieve a reduced number of members and a reduced number of manufacturing steps. The electronic component includes: a body configured from a ceramic, which has a first part and a second part that has a lower surface resistivity than the surface resistivity of the first part; and an external electrode formed on the surface of the second part.

10 Claims, 10 Drawing Sheets

(56) References Cited

U.S. PATENT DOCUMENTS

| | | | | |
|---|---|---|---|---|
| 2009/0243784 | A1* | 10/2009 | Iwasaki | H01F 17/0013 336/200 |
| 2011/0074535 | A1* | 3/2011 | Banno | H01F 17/0013 336/200 |
| 2014/0176286 | A1 | 6/2014 | Okada et al. | |
| 2014/0197917 | A1 | 7/2014 | Naito et al. | |
| 2016/0055955 | A1* | 2/2016 | Park | H01F 27/255 336/83 |

FOREIGN PATENT DOCUMENTS

| | | | | |
|---|---|---|---|---|
| JP | H07-074044 | A | | 3/1995 |
| JP | H08-181029 | A | | 7/1996 |
| JP | H09-148135 | A | | 6/1997 |
| JP | H09-186019 | A | | 7/1997 |
| JP | 2000-164417 | A | | 6/2000 |
| JP | 2002-231567 | A | | 8/2002 |
| JP | 2002-367833 | A | | 12/2002 |
| JP | 2003-297642 | A | | 10/2003 |
| JP | 2007-096215 | A | | 4/2007 |
| JP | 2011-091281 | A | | 5/2011 |
| JP | 2011091281 | A | * | 5/2011 |
| JP | 4710204 | B2 | | 6/2011 |
| JP | 2012-060013 | A | | 3/2012 |
| JP | 2012060013 | A | * | 3/2012 |
| JP | WO 2013024807 | A1 | * | 2/2013 ..... H01F 17/0013 |
| JP | 2013-254917 | A | | 12/2013 |
| KR | 2005-0008536 | A | | 1/2005 |
| WO | 2013-024807 | A1 | | 2/2013 |

OTHER PUBLICATIONS

An Office Action; "Notice of Reasons for Rejection," issued by the Japanese Patent Office dated Sep. 26, 2017, which corresponds to Japanese Patent Application No. 2015-040497 and is related to U.S. Appl. No. 15/056,696.

Notification of the Second Office Action issued by the State Intellectual Property Office of the People's Republic of China dated Mar. 12, 2018, which corresponds to Chinese Patent Application No. 201610096155.9 and is related to U.S. Appl. No. 15/056,696.

Gao et al.: Modern Electronic Technology Guideline; Science and Technology Literature Press; Feb. 2001; p. 26; Beijing, China.

An Office Action; "Notice of Reasons for Rejection," issued by the Japanese Patent Office dated Apr. 10, 2018, which corresponds to Japanese Patent Application No. 2015-040497 and is related to U.S. Appl. No. 15/056,696.

An Office Action; "Notification of Preliminary Rejection," issued by the Korean Patent Office dated Dec. 28, 2017, which corresponds to Korean Patent Application No. 10-2016-0024307 and is related to U.S. Appl. No. 15/056,696.

* cited by examiner

ELECTRONIC COMPONENT AND MANUFACTURING METHOD THEREFOR

CROSS REFERENCE TO RELATED APPLICATIONS

This application claims benefit of priority to Japanese Patent Application No. 2015-40497 filed Mar. 2, 2015, the entire content of which is incorporated herein by reference.

TECHNICAL FIELD

The present disclosure relates to an electronic component and a method for manufacturing the component.

BACKGROUND

Conventionally, electronic components include the electronic components described in Japanese Patent No. 4710204 and JP 2002-367833 A.

For the electronic component in Japanese Patent No. 4710204, an electrically conducting material is deposited on the surface of a body composed of a ceramic, and external electrodes are formed by electroplating with the electrically conducting material as a conductive layer.

For the electronic component described in JP 2002-367833 A, patterns for external electrodes are provided within a body, the patterns for external electrodes are partially exposed from the surface of the body, and on the exposed parts, external electrodes are formed by electroplating.

SUMMARY

Problem to be Solved by the Disclosure

However, for the electronic component described in Japanese Patent No. 4710204, in order to form the external electrodes on the body by electroplating, there is a need to deposit the electrically conducting material on the body, and the number of members is increased, and the step of manufacturing steps is increased.

In addition, for the electronic component described in JP 2002-367833 A, in order to form the external electrodes on the body by electroplating, there is a need to provide the patterns for the external electrodes in the body, and the number of members is increased, and the manufacturing steps are increased.

Therefore, an object of the present disclosure is to provide an electronic component and a manufacturing method therefor, which can achieve the reduced number of members and the reduced number of manufacturing steps.

Solution to the Problems

In order to solve the problems mentioned above, an electronic component according to the present disclosure includes:

a body configured from a ceramic, the body including a first part and a second part that has a lower surface resistivity than the surface resistivity of the first part; and an external electrode formed on a surface of the second part.

In the electronic component according to the present disclosure, the external electrode is formed on the surface of the second part with the lower surface resistivity in the body. Thus, the external electrode can be formed by electroplating on the surface of the second part. Therefore, there is no need to deposit an electrically conducting material on the body or provide a pattern for the external electrode in the body for forming the external electrode on the body by electroplating, thereby making it possible to reduce the number of members and the number of manufacturing steps.

In the electronic component according to an embodiment, the surface resistivity of the first part is higher than $10^5$ Ω·cm, and the surface resistivity of the second part is lower than $10^3$ Ω·cm.

In the electronic component according to the embodiment, the surface resistivity of the first part is higher than $10^5$ Ω·cm, and the surface resistivity of the second part is lower than $10^3$ Ω·cm. Thus, the external electrode is not formed on the first part, but formed on the second part by electroplating.

In addition, in the electronic component according to an embodiment, the surface resistivity of the second part is lower than $10^{-2}$ times as high as the surface resistivity of the first part.

In the electronic component according to the embodiment, the surface resistivity of the second part is lower than $10^{-2}$ times as high as the surface resistivity of the first part. Thus, the external electrode is not formed on the first part, but formed on the second part by electroplating.

In the electronic component according to an embodiment, the first part of the body is provided with a spiral coil conductor.

In the electronic component according to the embodiment, the first part of the body is provided with the coil conductor. Thus, even when a high-frequency magnetic field is generated by applying current to the coil conductor, the generation of eddy current in the body can be suppressed, because the first part with the higher surface resistivity is provided with the coil conductor.

In addition, in the electronic component according to an embodiment, the body includes a magnetic body.

In the electronic component according to the embodiment, the body includes the magnetic body. Thus, the electronic component can have a function as an inductor.

In the electronic component according to an embodiment, the first part includes Ni—Zn based ferrite, and the second part includes Mn—Zn based ferrite.

In the electronic component according to the embodiment, the resistivity of the Mn—Zn based ferrite is lower than the resistivity of the Ni—Zn based ferrite. Thus, the external electrode can be formed selectively on the second part.

In the electronic component according to an embodiment, the first part includes Ni—Zn based ferrite, and the second part includes Bi—Ni—Zn based ferrite.

In the electronic component according to the embodiment, the resistivity of the Bi—Ni—Zn based ferrite is lower than the resistivity of the Ni—Zn based ferrite. Thus, the external electrode can be formed selectively on the second part.

In the electronic component according to an embodiment, the first part includes Ni—Zn based ferrite, and the second part includes a metallic magnetic powder.

In the electronic component according to the embodiment, the metallic magnetic powder is partially exposed on the surface of the glass, and the resistivity of the glass including the metallic magnetic powder is thus lower than the resistivity of the Ni—Zn based ferrite. Thus, the external electrode can be formed selectively on the second part.

In the electronic component according to an embodiment, the body is formed by a sheet lamination method.

In this regard, the printing lamination method refers to a method of stacking and firing a first sheet composed of a material for the first part and a second sheet composed of a material for the second part, thereby preparing the body.

In the electronic component according to the embodiment, the body is formed by the sheet lamination method. Thus, the first part and the second part can be formed in a sheet lamination direction, and the boundary between the first part and the second part can be formed to be linear. Therefore, the external electrode formed on the second part has an edge formed to be linear. Thus, in the case of mounting the electronic component onto a circuit board, any unintended connecting part is not connected to the external electrode.

In addition, in the electronic component according to an embodiment, the body is formed by a printing lamination method.

In this regard, the printing lamination method refers to a method of laminating by printing and firing a first paste composed of a material for the first part and a second paste composed of a material for the second part, thereby preparing the body.

In the electronic component according to the embodiment, the body is formed by the printing lamination method. Thus, the degree of freedom is improved for the location where the second part is provided. Therefore, the external electrode formed on the second part has a degree of freedom increased.

Furthermore, a method for manufacturing an electronic component according to the present disclosure includes:

forming a body configured from a ceramic, the body including a first part and a second part that has a lower surface resistivity than the surface resistivity of the first part; and forming an external electrode by electroplating on the surface of the second part.

In the method for manufacturing an electronic component according to the present disclosure, the external electrode is formed by electroplating on the surface of the second part with the lower surface resistivity in the body. Therefore, there is no need to deposit an electrically conducting material on the body or provide a pattern for the external electrode in the body for forming the external electrode on the body by electroplating, thereby making it possible to reduce the number of members and the number of manufacturing steps.

Effect of the Disclosure

In the electronic component and manufacturing method according to the present disclosure, the external electrode is formed on the surface of the second part with the lower surface resistivity in the body. Thus, the number of members and the number of manufacturing steps can be reduced.

DETAILED DESCRIPTION

The present disclosure will be described in detail below with reference to embodiments as shown.

(First Embodiment)

Figure 1:
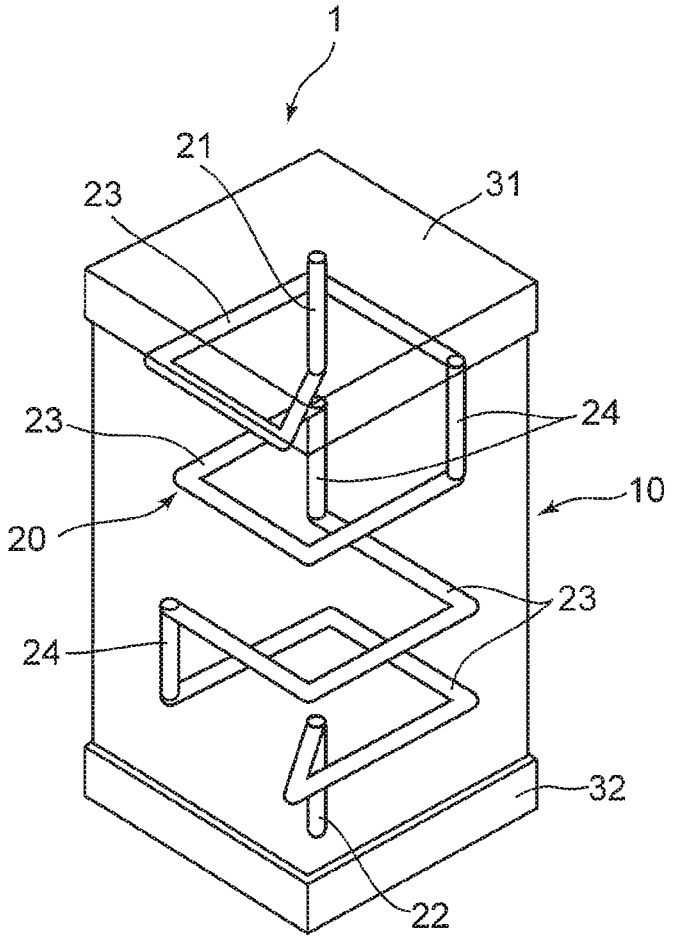
FIG. 1 is a perspective view illustrating a laminated inductor as an electronic component according to a first embodiment of the present disclosure.
Figure 2:
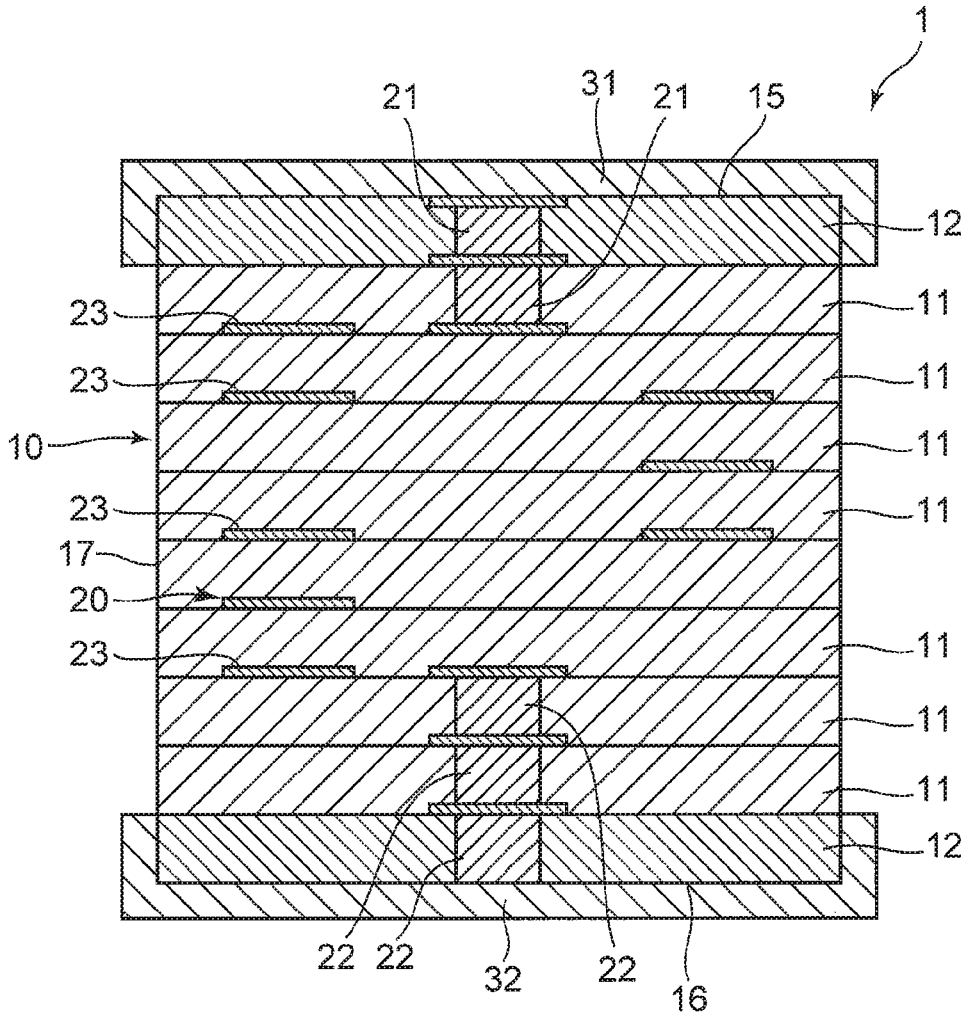
FIG. 2 is a cross-sectional view of the laminated inductor.

FIG. 1 is a perspective view illustrating an electronic component according to a first embodiment of the present disclosure. FIG. 2 is a cross-sectional view of the electronic component. As shown in FIGS. 1 and 2, the electronic component 1 according to the first embodiment has a body 10 composed of a ceramic, and external electrodes 31, 32 provided on the body 10. The body 10 includes a first part 11, and a second part 12 that has a lower surface resistivity than the surface resistivity of the first part 11. The external electrodes 31, 32 are formed on the surface of the second part 12 of the body 10.

The electronic component 1 according to the embodiment, which is configured as described above, differs mainly in the following respects from conventional electronic components.

The external electrodes 31, 32 are formed on the surface of the second part 12 with the lower surface resistivity in the body 10, and the external electrodes 31, 32 can be thus formed by electroplating on the surface of the second part 12. Therefore, there is no need to deposit an electrically conducting material on the body 10 or provide patterns for external electrodes in the body 10 for forming the external electrodes 31, 32 on the body 10 by electroplating, thereby making it possible to reduce the number of members and the number of manufacturing steps.

In addition, there is no need to provide patterns for external electrodes in the body 10, thus producing a degree of freedom for the design of circuit elements (coil patterns, etc.) inside the body 10.

A specific example of the electronic component according to the embodiment of the present disclosure will be described below.

As shown in FIGS. 1 and 2, the electronic component according to the first embodiment is a laminated inductor 1. The laminated inductor 1 has the body 10, a spiral coil conductor 20 provided inside the body 10, and external electrodes 31, 32 provided on the surface of the body 10 and electrically connected to the coil conductor 20. In FIG. 1, the coil conductor 20 is shown by a solid line in order to make it easy to discriminate the coil conductor 20.

The laminated inductor 1 is electrically connected to wiring of a circuit board, not shown, through the eternal electrodes 31, 32. The laminated inductor 1 is used as, for example, a noise rejection filter, and used for an electronic device such as a personal computer, a DVD player, a digital camera, a TV, a cellular phone, and car electronics.

The body 10 is composed of a ceramic. The body 10 includes first layers 11 as an example of the first part, and second layers 12 as an example of the second part. The body 10 is configured to have the first layers 11 and second layers 12 laminated. The second layers 12 are disposed at both ends in the laminating direction, and the plurality of first layers 11 is sandwiched by the second layers 12 at the both ends.

Figure 3:
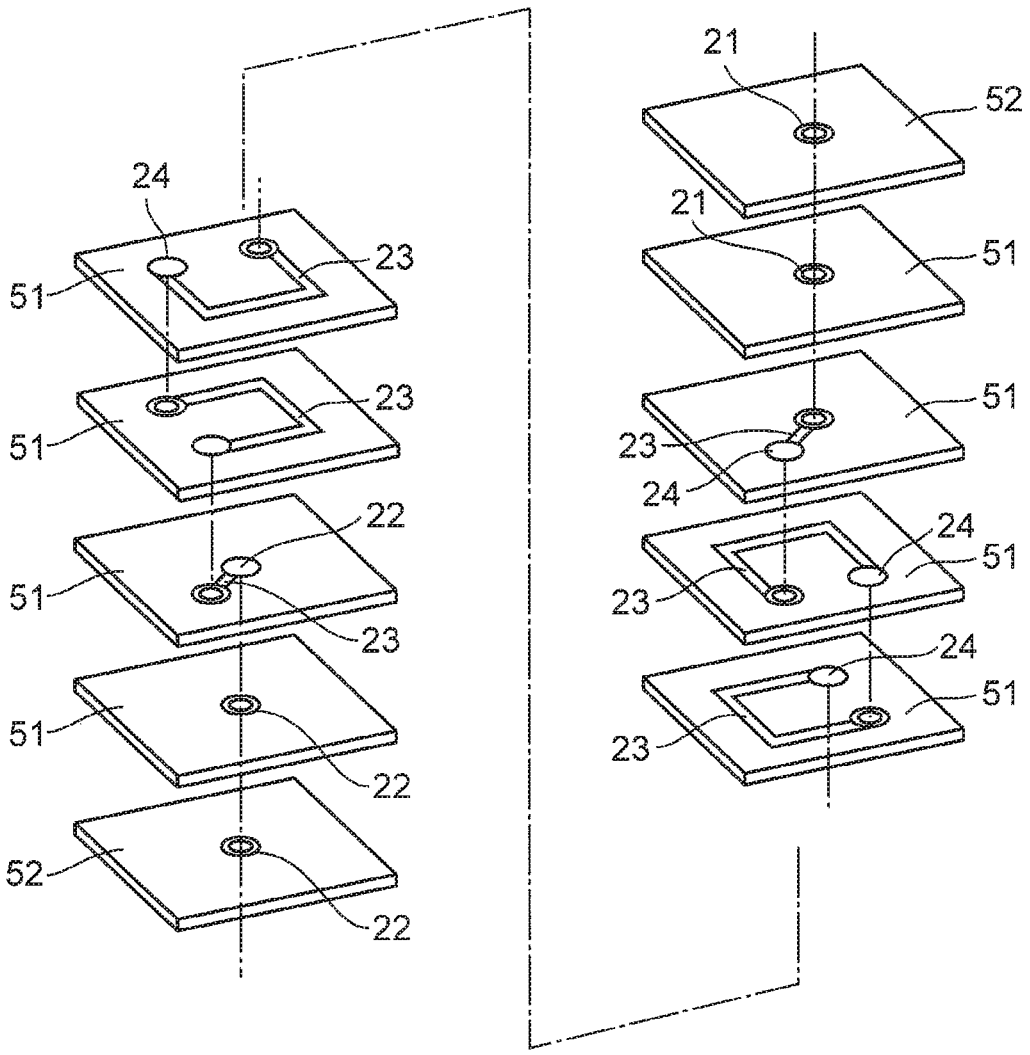
FIG. 3 is an explanatory diagram for explaining a method for manufacturing a laminated inductor.

More specifically, the body 10 is formed by a sheet lamination method. As will be described later for details, the sheet lamination method refers to a method of stacking and firing first sheets 51 composed of a material for the first layers 11 and second sheets 52 composed of a material for the second layers 12, thereby preparing the body 10, as shown in FIG. 3.

The surface resistivity of the second layer 12 is lower than the surface resistivity of the first layer 11. The surface resistivity of the second layer 12 is a surface resistivity such that plated films as the external electrodes 31, 32 can be formed on the surface of the second layer 12 by electroplating. The surface resistivity of the first layer 11 is a surface resistivity such that no plated film is formed on the surface of the first layer 11 by electroplating. Specifically, the surface resistivity of the first layer 11 is higher than $10^5$ Ω·cm, whereas the surface resistivity of the second layer 12 is lower than $10^3$ Ω·cm. Alternatively, the surface resistivity of the second layer 12 is lower than $10^{-2}$ times as high as the surface resistivity of the first layer 11. Thus, the external electrodes 31, 32 are formed by electroplating, not on the first layers 11, but on the second layers 12.

The body 10 is composed of a magnetic body. Thus, the laminated inductor 1 has a function as an inductor. The first layers 11 are composed of, for example, Ni—Zn based ferrite, whereas the second layers 12 are composed of, for example, Mn—Zn based ferrite. Therefore, a plated film can be selectively formed on the second layers 12, because the resistivity of the Mn—Zn based ferrite is lower than the resistivity of the Ni—Zn based ferrite. Specifically, the resistivity of the M-Zn based ferrite is 10 Ω·cm to 1000 Ω·cm, and because of the low resistivity, plating is easily grown. The resistivity of the Ni—Zn based ferrite is 100 Ω·cm or more, and because of the high resistivity, plating is not grown.

The body 10 is formed in a substantially cuboid shape. The surface of the body 10 has a first end surface 15, a second end surface 16 located on the side opposite to the first end surface 15, and a side surface 17 located between the first end surface 15 and the second end surface 16. The first end surface 15 is disposed at one end in the laminating direction, whereas the second end surface 16 is disposed at the other end in the laminating direction.

The external electrodes 31, 32 are formed by electroplating on the outer surfaces of the second layers 12 of the body 10. The plating is, for example, Ni plating or Sn plating. It is to be noted that the plating may have a two-layer structure obtained by carrying out Ni plating, and then Sn plating, or a plated film of Ag or Cu formed on Ni plating as a base.

The first external electrode 31 covers the entire first end surface 15 of the body 10, and an end the side surface 17 of the body 10, which is closer to the first end surface 15. The second external electrode 32 covers the entire second end surface 16 of the body 10, and an end the side surface 17 of the body 10, which is closer to the second end surface 16. More specifically, the first and second external electrodes 31, 32 are each provided on five faces of the body 10.

The coil conductor 20 is composed of a conductive material such as Ag or Cu. The coil conductor 20 is wound in a spiral form along the laminating direction. The coil conductor 20 is, at either end thereof, provided with a first extraction conductor 21 and a second extraction conductor 22.

The first extraction conductor 21 is exposed from the first end surface 15 of the body 10, and brought into contact with the first external electrode 31, and the first external electrode 31 is electrically connected to the coil conductor 20 through the first extraction conductor 21. The second extraction conductor 22 is exposed from the second end surface 16 of the body 10, and brought into contact with the second external electrode 32, and the second external electrode 32 is electrically connected to the coil conductor 20 through the second extraction conductor 22.

The coil conductor 20 is provided in the first layers 11 of the body 10. The coil conductor 20 has coil pattern parts 23 formed on upper surfaces of the first layers 11, and pattern connecting parts (via conductors) 24 disposed to pass through the first layers 11 in the thickness direction. The spiral coil conductor 20 is formed in such a manner that the respective coil pattern parts 23 have ends connected by the pattern connecting parts 24. As just described, the coil conductor 20 is provided in the first layers 11 with a high surface resistivity, and the generation of eddy current in the body 10 can be thus suppressed even when a high-frequency magnetic field is generated by applying current to the coil conductor 20.

Next, a method for manufacturing the laminated inductor 1 will be described.

As shown in FIG. 3, prepared are: a plurality of first sheets 51 composed of a material for the first layers 11; and two second sheets 52 composed of a material for the second layers 12. One of the second sheets 52 is provided with the first extraction conductor 21 by printing, whereas the other second sheet 52 is provided with the second extraction conductor 22 by printing. The plurality of first sheets 51 is provided with the first and second extraction conductors 21, 22, the coil pattern parts 23, and the pattern connecting parts 24. Then, a stacked body is formed by stacking such that the plurality of first sheets 51 is sandwiched by the two second sheets 52, and the stacked body is subjected to firing to prepare the body 10. As just described, the body 10 is formed by a sheet lamination method. The first sheets 51 constitute the first layers 11, whereas the second sheets 52 constitute the second layers 12.

Thereafter, as shown in FIG. 2, the body 10 is immersed in a plating solution, and subjected to electroplating. Then, because the second layers 12 of the body 10 have a lower surface resistivity, the first external electrode 31 is formed on the surface of the second layer 12 closer to the first end surface 15, whereas the second external electrode 32 is formed on the surface of the second layer 12 closer to the second end surface 16.

Accordingly, in accordance with the laminated inductor 1 and the manufacturing method therefor, the first and second external electrodes 31, 32 are formed by electroplating on the second layers 12 with the lower surface resistivity in the body 10. Therefore, there is no need to deposit an electrically conducting material on the body 10 or provide patterns for the external electrodes in the body 10 for forming the external electrodes 31, 32 on the body 10 by electroplating, thereby making it possible to reduce the number of members and the number of manufacturing steps.

In addition, the electroplating is carried out with a difference in surface resistivity provided between the first layers 11 and second layers 12 of the body 10, and the first and second external electrodes 31, 32 can be thus formed only on a required part of the body 10. In addition, the first and second external electrodes 31, 32 are formed by electroplating, and the first and second external electrodes 31, 32 can be reduced in thickness. In contrast, in the case of using a dip method of applying and baking a conductor paste to the body as a method for forming the external electrodes, the external electrodes are relatively large in thickness, and there is thus a need to design the size itself of the body to be small with respect to a desired product size.

In addition, there is no need to provide patterns for external electrodes in the body 10, thus producing a degree of freedom for the design of circuit elements (coil patterns, etc.) inside the body 10.

In addition, the body 10 is formed by the sheet lamination method. Thus, the first layers 11 and the second layers 12 can be formed in a sheet lamination direction, and the boundaries between the first layers 11 and the second layers 12 can be formed to be linear. Therefore, the first and second external electrodes 31, 32 formed on the second layers 12 have edges formed to be linear. For example, the edges of the first and second external electrodes 31, 32 cause no upward wetting, thus resulting in no protruded shape. Thus, in the case of mounting the laminated inductor 1 onto a circuit board, any unintended connecting part is not connected to the external electrodes 31, 32.

(Second Embodiment)

A laminated inductor as an electronic component according to a second embodiment of the present disclosure differs from the first embodiment in the materials of the first layers and second layers of the body. Only the different composition will be described below.

In the second embodiment, the first layers are composed of Ni—Zn based ferrite, whereas the second layers are composed of Bi—Ni—Zn based ferrite. Therefore, first and second external electrodes can be formed selectively on the second layers, because the resistivity of the Bi—Ni—Zn based ferrite is lower than the resistivity of the Ni—Zn based ferrite.

(Third Embodiment)

A laminated inductor as an electronic component according to a third embodiment of the present disclosure differs from the first embodiment in the materials of the first layers and second layers of the body. Only the different composition will be described below.

In the third embodiment, the first layers are composed of Ni—Zn based ferrite, whereas the second layers are composed of glass including a metallic magnetic powder. Therefore, the metallic magnetic powder is partially exposed on the surface of the glass, and the resistivity of the glass including the metallic magnetic powder is thus lower than the resistivity of the Ni—Zn based ferrite. Thus, the first and second external electrodes can be formed selectively on the second layers.

(Fourth Embodiment)

Figure 4:
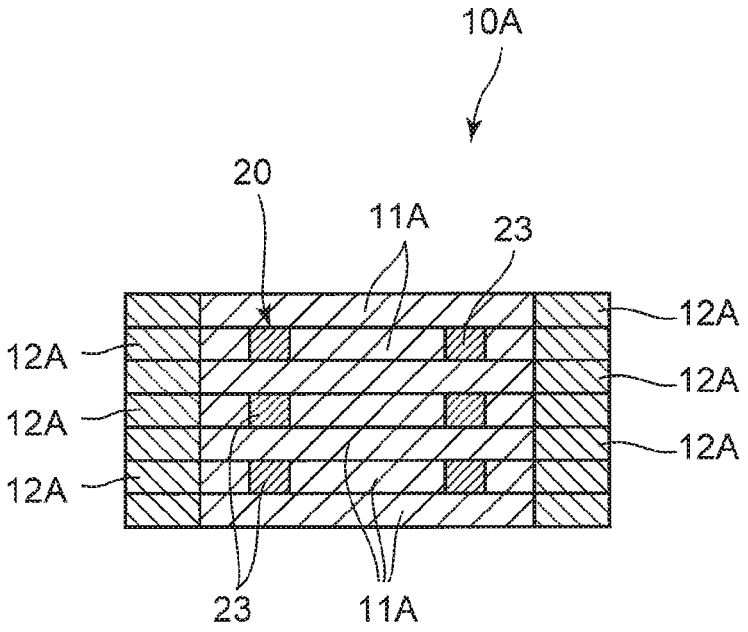
FIG. 4 is a cross-sectional view illustrating a laminated inductor as an electronic component according to a fourth embodiment of the present disclosure.

FIG. 4 is a cross-sectional view illustrating a laminated inductor as an electronic component according to a fourth embodiment of the present disclosure. The fourth embodiment differs from the first embodiment in the method of preparing the body. The different composition will be described below.

As shown in FIG. 4, a body 10A is formed by a printing lamination method in the fourth embodiment. The printing lamination method refers to a method of laminating by printing and firing a first paste composed of a material for the first layers 11A (first part) and a second paste composed of a material for the second layers 12A (second part), thereby preparing the body 10. The material of the first layers 11A is the same as the material of the first layers 11 according to the first embodiment, whereas the material of the second layers 12A is the same as the material of the second layers 12 according to the first embodiment.

The method of preparing the body 10A will be described.

Figure 5A:
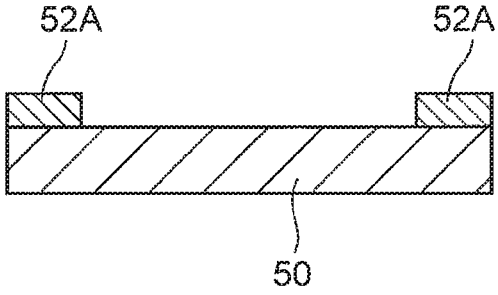
FIG. 5A is an explanatory diagram for explaining a method for manufacturing a laminated inductor.
Figure 5B:
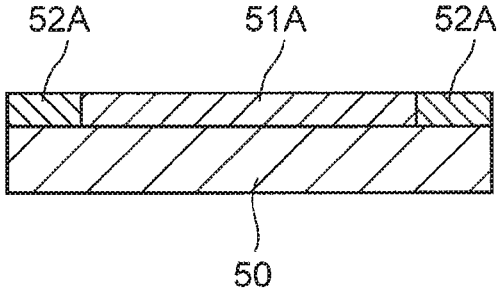
FIG. 5B is an explanatory diagram for explaining the method for manufacturing a laminated inductor.

As shown in FIG. 5A, a second paste 52A composed of a material for the second layer 12A is applied by printing to two points spaced from each other on a substrate 50, and the second paste 52 is dried. Thereafter, as shown in FIG. 5B, a first paste 51A composed of a material for the first layers 11A is applied by printing so as to fill the space between the second pastes 52A at the two points, and the first paste 51A is dried.

Figure 5C:
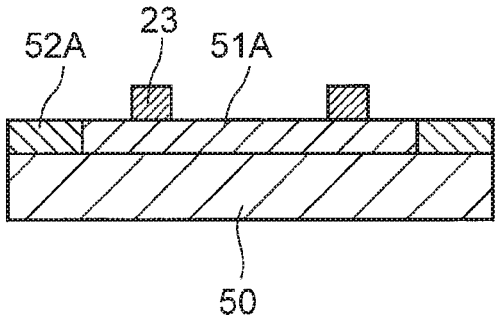
FIG. 5C is an explanatory diagram for explaining the method for manufacturing a laminated inductor.
Figure 5D:
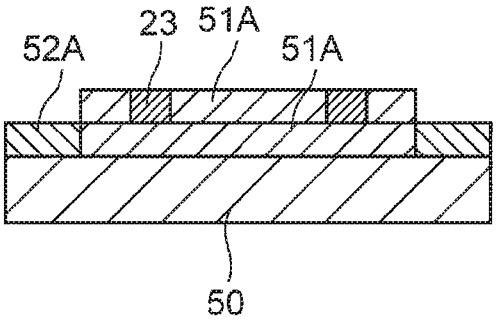
FIG. 5D is an explanatory diagram for explaining the method for manufacturing a laminated inductor.

Thereafter, as shown in FIG. 5C, a coil pattern part 23 is applied by printing onto the first paste 51A, and dried. Thereafter, as shown in FIG. 5D, on the first paste 51A as a first layer, a first paste 51A as a second layer is applied by printing, and dried.

Figure 5E:
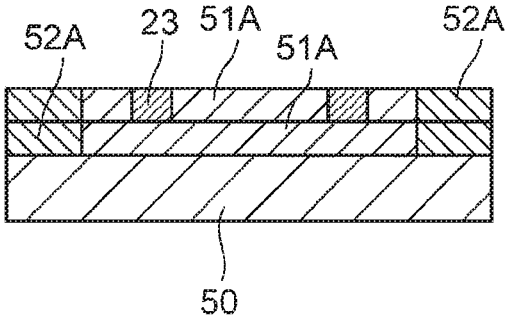
FIG. 5E is an explanatory diagram for explaining the method for manufacturing a laminated inductor.

Thereafter, as shown in FIG. 5E, on the second paste 52A as a first layer, a second paste 52A as a second layer is applied by printing, and dried. The foregoing steps are repeated to laminate the first paste 51A and the second paste 52A by printing, thereby forming a laminated body, and the laminated body is subjected to firing, thereby preparing the body 10A shown in FIG. 4. In the thus prepared body 10A, the second layers 12A can be disposed at both ends along a direction perpendicular to the direction of stacking the first layers 11A and the second layers 12A.

Therefore, the body 10A is formed by the printing lamination method. Thus, the degree of freedom is improved for the locations where the second layers 12A are provided. Therefore, the first and second external electrodes formed on the second layers 12A have a degree of freedom increased. For example, the first and second external electrodes can be provided on any surface of the body 10A, thereby making it possible to form L-shaped electrodes and bottom electrodes.

(Fifth Embodiment)

Figure 6:
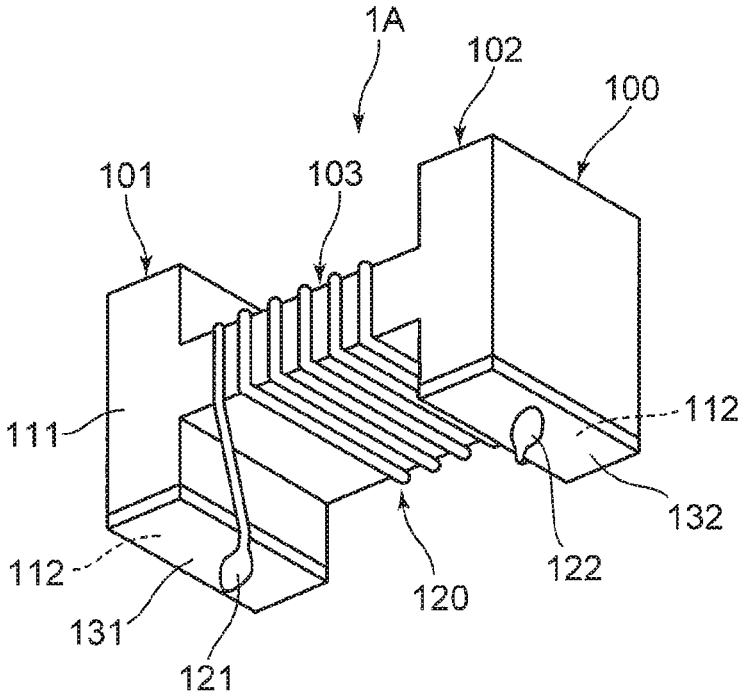
FIG. 6 is a perspective view illustrating a wound inductor as an electronic component according to a fifth embodiment of the present disclosure.

FIG. 6 is a perspective view illustrating a wound inductor as an electronic component according to a fifth embodiment of the present disclosure. The fifth embodiment differs from the first embodiment in the intended use of the electronic component. The different composition will be described below.

As shown in FIG. 6, the electronic component according to the fifth embodiment is a wound inductor 1A. The wound inductor 1A has a core 100, a wire 120 wound around the core 100, and external electrodes 131, 132 provided on the core 100. The core 100 is an example of the body. The wire 120 is an example of the coil conductor.

The core 100 has a winding core part 103, a first flange 101 provided at one axial end of the winding core part 103, and a second flange 102 provided at the other axial end of the winding core part 103. The core 100 includes a first part 111 and a second part 112. The material of the first part 111 is the same as the material of the first layers 11 according to the first embodiment, whereas the material of the second part 112 is the same as the material of the second layers 12 according to the first embodiment.

When a side of the core 100 to be mounted on a circuit board is regarded as a bottom side, the bottom part of the first flange 101 and the bottom part of the second flange 102 are composed of the second part 112, whereas the part of the first flange 101 excluding the bottom part, the part of the second flange 102 excluding the bottom part and the winding core part 103 are composed of the first part 111.

The external electrodes 131, 132 are formed by electroplating on the outer surface of the second part 112 of the core 100. The material of the external electrodes 131, 132 is the same as the material of the external electrodes 31, 32 according to the first embodiment. The first external electrode 131 covers the second part 112 for the bottom part of the first flange 101. The second external electrode 132 covers the second part 112 for the bottom part of the second flange 102.

The wire 120 is wound in spiral form around the winding core part 103. The first end 121 of the wire 120 is electrically connected to the first external electrode 131 on the first flange 101, whereas the second end 122 of the wire 120 is electrically connected to the second external electrode 132 on the second flange 102. The wire 120 has, for example, a conductor such as Cu, Ag, or Au, and a coating that coats the conductor.

Next, a method for manufacturing the wound inductor 1A will be described.

Figure 7A:
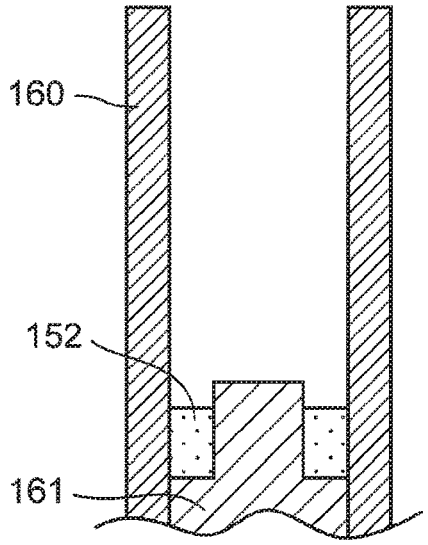
FIG. 7A is an explanatory diagram for explaining a method for manufacturing a wound inductor.
Figure 7B:
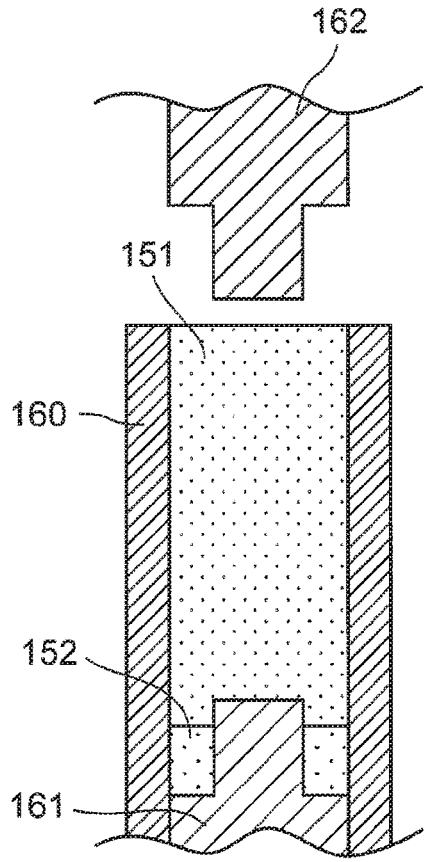
FIG. 7B is an explanatory diagram for explaining the method for manufacturing a wound inductor.

As shown in FIG. 7A, with a first press part 161 inserted in a pressing mold 160, a second powder material 152 composed of a material for the second part 112 is put onto the first press part 161 in the mold 160. Thereafter, as shown in FIG. 7B, a first powder material 151 composed of a material for the first part 111 is adapted to fill the space on the second powder 152 in the mold 160.

Figure 7C:
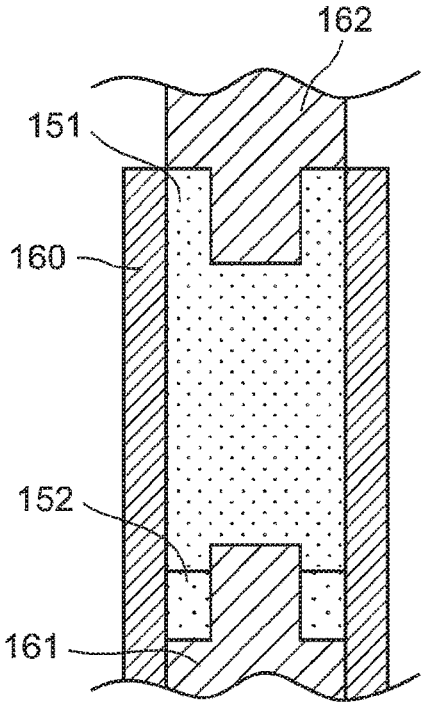
FIG. 7C is an explanatory diagram for explaining the method for manufacturing a wound inductor.
Figure 7D:
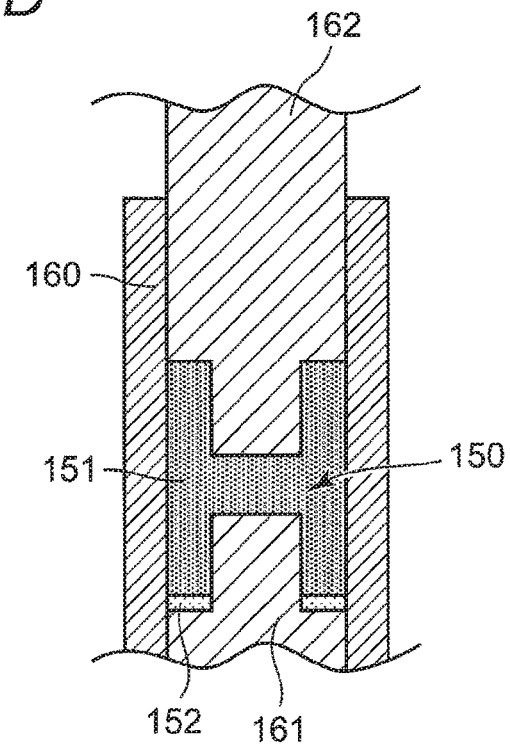
FIG. 7D is an explanatory diagram for explaining the method for manufacturing a wound inductor.

Thereafter, as shown in FIG. 7C, a second press part 162 is inserted into the mold 160 from the side opposite to the first press part 161. Then, as shown in FIG. 7D, the second press part 162 is brought in close to the first press part 161 to cause the first press part 161 and the second press part 162 to apply pressure to the first powder material 151 and the second powder 152, thereby forming a compact 150.

Figure 7E:
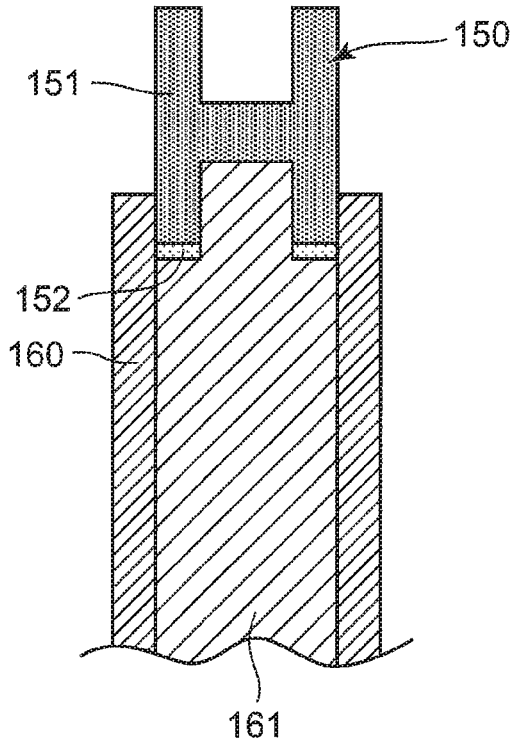
FIG. 7E is an explanatory diagram for explaining the method for manufacturing a wound inductor.

Thereafter, as shown in FIG. 7E, the second press part 162 is pulled from the mold 160, and with the first press part 161, the compact 150 is extruded from the mold 160. The shape of the compact 150 coincides with the shape of the core 100 including the first flange 101, the second flange 102, and the winding core part 103. Therefore, a part of the compact 150 corresponding to the bottom of the first flange 101 and a part of the compact 150 corresponding to the bottom of the second flange 102 are composed of the second powder material 152. Thereafter, the compact 150 is subjected to firing to prepare the core 100.

Thereafter, as shown in FIG. 6, the core 100 is immersed in a plating solution, and subjected to electroplating. Then, because the second part 112 of the core 100 has a low surface resistivity, the first external electrode 131 is formed on the surface of the second part 112 as the first flange 101, whereas the second external electrode 132 is formed on the surface of the second part 112 as the second flange 102.

Accordingly, in accordance with the wound inductor 1A, the first and second external electrodes 131, 132 are formed by electroplating on the second part 112 with the lower surface resistivity in the core 100. Therefore, there is no need to deposit an electrically conducting material on the core 100 or provide patterns for the external electrodes on the core 100 for forming the external electrodes 131, 132 on the core 100 by electroplating, thereby making it possible to reduce the number of members and the number of manufacturing steps.

It is to be noted that the present disclosure is not limited to the embodiments described above, design changes can be made without departing from the scope of the present disclosure. For example, the respective features of the first through fifth embodiments may be combined in various forms.

While the laminated inductor or the wound inductor is adopted as an example of the electronic component in the embodiments, the electronic component may be a laminated capacitor including an internal electrode or a laminated capacitor including no internal electrode, or a PTC thermistor or an NTC thermistor, and any other electronic component may be adopted as long as the electronic component has a body configured from a ceramic and an external electrode provided on the body.

While the materials are listed as mentioned above as an example of the body material in the embodiments, any material may be adopted as long as the body has the first part and second part that are different in surface resistivity. In addition, the material of the body may be a magnetic body or a non-magnetic body.

While the first part of the body is provided with the coil conductor in the embodiments, the second part of the body may be provided with at least a part of the coil conductor.

While the first part and second part of the body are composed of layers in the embodiments, the first part may be composed of a block, whereas paint or the like may be applied for the second part.

The body is formed by the sheet lamination method or the printing lamination method in the embodiment, but may be formed with a 3D printer or the like.

EXAMPLES

Example 1

Next, an example according to the first embodiment of the present disclosure will be described.

Slurry including a raw material for Ni—Zn based ferrite and an aqueous binder was formed into the shape of a sheet to form first green sheets. In addition, slurry including a raw material for Mn—Zn based ferrite and an aqueous binder was formed into the shape of a sheet to form second green sheets.

After forming a via hole in a predetermined position of each green sheet prepared, a conductive paste was applied by printing to the upper surfaces of the green sheets to form a coil pattern.

Next, with the use of the second green sheets for a part (second part) desiring external electrodes and the first green sheets for a part (first part) desiring no external electrode, the multiple green sheets were stacked and subjected to pressure bonding, thereby preparing an unfired laminated body.

The unfired laminated body was cut, if necessary, and then subjected to firing at 900° C., thereby providing a sintered body. Thereafter, the body was chamfered by barrel finishing, and then subjected to electroplating for forming external electrodes.

In this regard, plating was grown only on a surface of the body composed of Mn—Zn based ferrite, whereas no plating was grown on a surface of the body composed of the Ni—Zn based ferrite. The plating was Ni plating or Sn plating. A two-layer structure may be provided by carrying out Sn plating after Ni plating, or a plated film of Ag or Cu may be formed as a base for Ni plating. Thus, a laminated inductor with a spiral coil conductor was obtained.

An example of the Mn—Zn based ferrite composition will be described. The example has, as a fundamental composition, 50 to 65 mol % of $Fe2O_3$, 23 to 40 mol % of MnO, and 5 to 27 mol % of ZnO. The resistivity is 10 to 600 Ω·cm.

An example of the Ni—Zn based ferrite composition will be described. The example has, as a fundamental composition, 40 to 50 mol % of $Fe_2O_3$, 5 to 45 mol % of NiO, 1 to 32 mol % of ZnO, and 5 to 15 mol % of CuO. The resistivity is higher than $10^5$ Ω·cm.

Example 2

Next, an example according to the second embodiment of the present disclosure will be described.

In EXAMPLE 2, Ni—Zn based ferrite containing Bi is used in place of the Mn—Zn based ferrite in EXAMPLE 1. The other is the same as in EXAMPLE 1, and the description will be thus left out.

When the unfired laminated body was subjected to firing at 900° C., the added Bi caused abnormal grain growth of the ferrite in the second green sheet part, thereby decreasing the resistivity of the ferrite part containing Bi.

An example of the Bi—Ni—Zn based ferrite composition will be described. The example has, as a fundamental composition, 40 to 50 mol % of $Fe_2O_3$, 5 to 45 mol % of NiO, 1 to 32 mol % of ZnO, and 5 to 15 mol % of CuO. $Bi_2O_3$ as a small amount of additive, is contained in the range of 0.05 to 1.0 wt % with respect to 100% by weight of the main constituent. The resistivity is lower than $10^3$ Ω·cm.

An example of the Ni—Zn based ferrite composition will be described. The example has, as a fundamental composition, 40 to 50 mol % of $Fe_2O_3$, 5 to 45 mol % of NiO, 1 to 32 mol % of ZnO, and 5 to 15 mol % of CuO. The resistivity is higher than $10^5$ Ω·cm.

Example 3

Next, an example according to the third embodiment of the present disclosure will be described.

In EXAMPLE 3, glass including a metallic magnetic power is used in place of the Mn—Zn based ferrite in EXAMPLE 1. The rest is the same as in EXAMPLE 1, and the description will be thus left out.

The metallic magnetic powder is electrically conductive. In the barrel treatment for chamfering the fired body, the metallic magnetic powder on the surface of a part (second part) for the formation of external electrodes was polished to expose the inside of the metallic magnetic powder at the surface of the second part. For this reason, the second part had a surface resistivity deceased. As a result, external electrodes could be formed by plating on the second part.

An example of the glass composition including the metallic magnetic property will be described. A Fe—Si—Cr based magnetic metallic powder of 6 μm in average particle size, with 92.0% by weight of Fe, 3.5% by weight of Si, and 4.5% by weight of Cr, was prepared as a magnetic metallic material. In addition, a glass powder of borosilicate alkali glass of 1 μm in average particle size, with 79% by weight of $SiO_2$, 19% by weight of $B_2O_3$, and 2% by weight of $K_2O$, and with a softening point of 760° C. was prepared as a glass material. Then, the magnetic metallic material and the glass material were mixed so that the magnetic metallic powder was 88% by weight and the glass powder was 12% by weight, and a mechanofusion method was used to coat the surface of the magnetic metallic material with the glass material, thereby preparing a raw material for a magnetic body. The resistivity was 0.1 to 10 Ω·cm.

An example of the Ni—Zn based ferrite composition will be described. The example has, as a fundamental composition, 40 to 50 mol % of $Fe_2O_3$, 5 to 45 mol % of NiO, 1 to 32 mol % of ZnO, and 5 to 15 mol % of CuO. The resistivity is higher than $10^5$ Ω·cm.

Example 4

Next, an example according to the fourth embodiment of the present disclosure will be described.

Prepared were: a magnetic body (for example, Ni—Zn based ferrite) paste that has a high resistivity after firing; a magnetic body (for example, Mn—Zn based ferrite) paste that has a low resistivity after firing; and a conductive (for example, silver) paste for a coil conductor.

When the pastes were applied by printing in predetermined patterns, and at the same time, laminated, a part (second part) with external electrodes formed was formed from the paste for the low resistivity, whereas the other (first part) was formed from the paste for the high resistivity, thereby creating an unfired laminated body. It is to be noted that for the coil conductor, a conductive paste was used to prepare a coil pattern.

This unfired laminated body was cut, if necessary, and then subjected to firing, thereby providing a sintered body. The part with external electrodes formed by plating is the same as in EXAMPLE 1.

The invention claimed is:

1. An electronic component comprising:

a body configured from a ceramic, the body including a first part and a second part disposed at each of opposite ends of the body in a laminating direction, the second part having a lower surface resistivity than a surface resistivity of the first part;

a coil conductor; and external electrodes, each of which is formed on a surface of a respective one of the second parts disposed at the opposite ends of the body, wherein the coil conductor is wound in a spiral form along the laminating direction, wherein the coil conductor is provided in the first part, each of the second parts has a portion forming a part of an outer periphery of the body, and each of the external electrodes is formed on an entirety of the portion of the respective one of the second parts.

2. The electronic component according to claim 1, wherein the surface resistivity of the first part is higher than $10^5$ Ω•cm, and the surface resistivity of each of the second parts is lower than $10^3$ Ω•cm.

3. The electronic component according to claim 1, wherein the surface resistivity of each of the second parts is lower than $10^{-2}$ times as high as the surface resistivity of the first part.

4. The electronic component according to claim 1, wherein the first part of the body is provided with the spiral coil conductor.

5. The electronic component according to claim 1, wherein the body comprises a magnetic body.

6. The electronic component according to claim 1, wherein the first part comprises Ni—Zn based ferrite, and each of the second parts comprises Mn—Zn based ferrite.

7. The electronic component according to claim 1, wherein the first part comprises Ni—Zn based ferrite, and each of the second parts comprises Bi—Ni—Zn based ferrite.

8. The electronic component according to claim 1, wherein the first part comprises Ni—Zn based ferrite, and each of the second parts comprises glass including a metallic magnetic powder.

9. The electronic component according to claim 1, wherein the body is formed by a sheet lamination method.

10. The electronic component according to claim 1, wherein the body is formed by a printing lamination method.

* * * * *